US005435855A

United States Patent [19]

Allard

[11] Patent Number: 5,435,855

[45] Date of Patent: Jul. 25, 1995

[54] DISHWASHER GUARD

[76] Inventor: Debbie Allard, 283 Labreche Drive, North Bay, Ontario, Canada, P1A 4J5

[21] Appl. No.: 233,779

[22] Filed: Apr. 26, 1994

[30] Foreign Application Priority Data

Apr. 6, 1993 [CA] Canada ..... 2093464

[51] Int. Cl.[6] ..... B08B 13/00

[52] U.S. Cl. ..... 134/201; 200/43.19; 68/3 R

[58] Field of Search ..... 200/43.01, 43.02, 43.19, 200/43.16, 43.04, 43.18, 43.21, 43.03, 43.13, 333, 334, DIG. 12; 174/66, 67; 134/57 D, 58 D, 56 D, 201; 68/12.27, 3 R

[56] References Cited

U.S. PATENT DOCUMENTS

| | | | |
|---|---|---|---|
| 2,589,699 | 3/1952 | Johnson | 312/204 |
| 2,729,530 | 1/1956 | Mustee | 312/228 |
| 2,891,560 | 6/1959 | Ullman et al. | 134/58 |
| 3,109,900 | 11/1963 | Van Hook | 200/43.19 |
| 3,746,818 | 7/1973 | Bertelloti . | |
| 3,895,205 | 7/1975 | Tharp | 200/43.04 |
| 3,993,376 | 11/1976 | Meldahl | 312/228 |
| 4,102,471 | 7/1978 | Lore et al. . | |
| 4,577,076 | 3/1986 | Whelan, Jr. . | |
| 5,150,913 | 9/1992 | Hoelzl | 200/43.18 |
| 5,279,134 | 1/1994 | Nonogaki et al. | 68/12.27 |

FOREIGN PATENT DOCUMENTS

| | | | |
|---|---|---|---|
| 704115 | 2/1965 | Canada | 141/9 |
| 1086368 | 9/1980 | Canada | 312/81 |
| 2058213 | 12/1991 | Canada . | |
| 531929 | 8/1931 | Germany | 200/43.19 |

*Primary Examiner*—Frankie L. Stinson

*Attorney, Agent, or Firm*—Dennison, Meserole, Pollack & Scheiner

[57] ABSTRACT

A dishwasher guard for protecting the control panel of a dishwasher against accidental operation, in particular by a child. The guard comprises a door and a pair of lateral brackets adapted to be installed on the sides of the dishwasher. The brackets hingedly support the door and secure door latches. The door has a pair of opposite protruding inserts, each pivotally engaging a bracket. A pair of opposite latches is also provided on the door, each latch being locked into a respective bracket for maintaining the door closed over the dishwasher control panel.

13 Claims, 4 Drawing Sheets

DISHWASHER GUARD

FIELD OF THE INVENTION

The present invention relates to a dishwasher guard and more particularly to a guard for protecting the control panel of a dishwasher against accidental operation by a child.

BACKGROUND OF THE INVENTION

In domestic type dishwasher machines the control panel is usually arranged at a height accessible by small children. If the dishwasher is operated accidentally by a child, and e.g. the water supply is not turned on, the dishwasher may be damaged. As well, if during a machine cycle, an incorrect control is started, the damage caused by such an action can be very costly.

It is an object of the present invention to provide a dishwasher guard which is easy to install on an existing dishwasher, for protecting the control panel of the dishwasher against accidental operation.

It is another object of the present invention to provide a guard which can not be opened accidentally and is substantially child-proof, in that it requires the simultaneous use of both hands for such an action.

SUMMARY OF THE INVENTION

Accordingly, the present invention provides a dishwasher guard for protecting the dishwasher control panel against accidental operation comprising: support means adapted for installation on the dishwasher lateral sides at the level of the control panel; and a door means adapted to assume a closed position, when said control panel is protected and an open position, when said control panel is accessible, said door means being provided with;

(a) hinge means for connection of said door means on said support means; and (b) latch means operable to lock said door means in said support means.

The door has a frame which supports a facade. Preferably, the facade is manufactured from a webbed sheet, for allowing hot air build-up in the proximity of the dishwasher to emerge freely from the space enclosed by the guard door. Such webbing may include strips arranged perpendicularly to form rectangular or square spaces. The facade may also be moulded with the spaces of any desired shape.

Preferably, the hinge means comprises two inserts extending laterally from the door frame and hinged in the support means. The inserts may be arranged at the lower or upper part of the frame. Accordingly, the latch means should be arranged at the upper or lower part of the frame, respectively.

In an alternative embodiment, the hinge means may be arranged on one lateral side of the frame. Accordingly, the latch means should be arranged at the other lateral side, while the support means are installed on the corresponding lateral side of the dishwasher. With this arrangement, the door opens laterally.

According to another embodiment, the door means comprises two door sections, each hinged to a corresponding lateral side of the dishwasher. Any convenient latch means for locking the sections to each other could be used.

Thus, the dishwasher guard of the present invention is an inexpensive device which can be installed on any domestic dishwasher to provide a safe protection of the dishwasher control panel against accidental operation.

BRIEF DESCRIPTION OF THE DRAWINGS

The above and other objects, features and advantages of the present invention will become more apparent from the following detailed description taken in conjunction with the accompanying drawings, in which.

DESCRIPTION OF THE PREFERRED EMBODIMENTS

Figure 1:
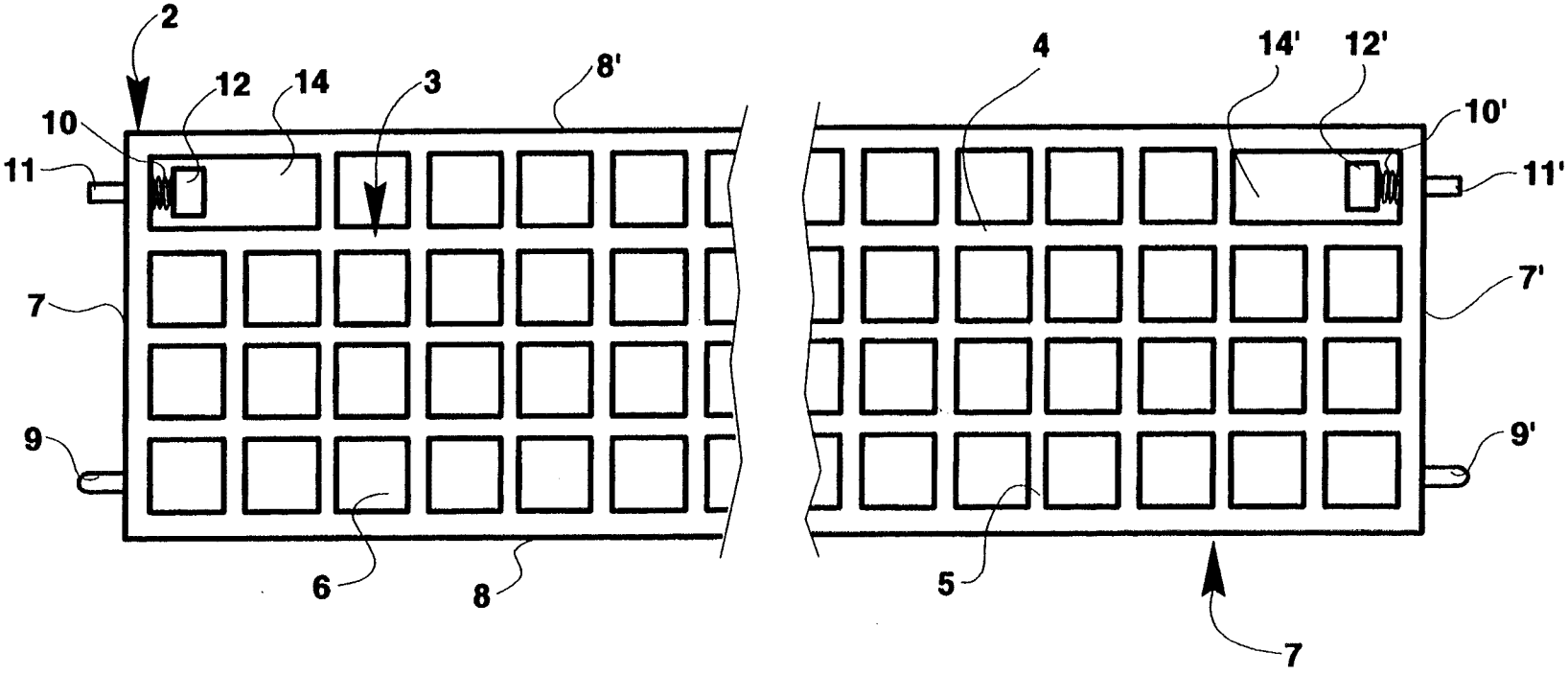
FIG. 1 illustrates the door of a dishwasher guard of an embodiment of the present invention.

FIG. 1 shows a preferred embodiment of a door, generally referred to by numeral 1. The door comprises a frame 2 and a webbed facade 3 of horizontal strips 4 and vertical strips 5. Any arrangement of strips 4 and 5 can be used, as long as the size of openings 6 between strips is kept small enough to avoid the penetration by the finger of a child. The embodiment shown in FIG. 1 is preferred since, besides preventing a child from touching the dishwasher controls, it allows hot air built up in the vicinity of the control panel to emerge and dissipate freely. Any type of metal or heat-resistant plastic may be used for the strips. However, the strips should be manufactured with smooth, non-sharp margins. The strips 4, 5 are connected to the frame 2 by e.g. welding, moulding or any suitable method.

The size of the door is dictated by the height of the control panel and the width of the dishwasher. Since these dimensions are generally standardized, the guard of the present invention may be used with a variety of conventional dishwashers. In any case, the door generally has a rectangular shape, with a left lateral panel 7 and a right lateral panel 7', somewhat longer than the height of the dishwasher control panel. The length of upper and lower panels 8 and 8' is substantially equal to the width of the dishwasher to be protected.

A left insert 9 and a right insert 9' are provided at the lower part of a respective left and right frame panel 7, 7'. Spring-loaded locks 10 and 10' are arranged on panels 7 and 7', respectively, close to the upper panel 8' of the frame 2. Each lock has a head 12, 12' and a body 11, 11'. A lock is arranged such that the body penetrates outwardly through the respective panel of the frame 2. The head is accessible through an opening 14 respectively 14' in facade 3. The spring-loaded locks are of a conventional type.

Alternately, the inserts could be provided at the upper part of panels 7, 7' and the spring-loaded latches at the lower part of panels 7, 7'.

Figure 2:
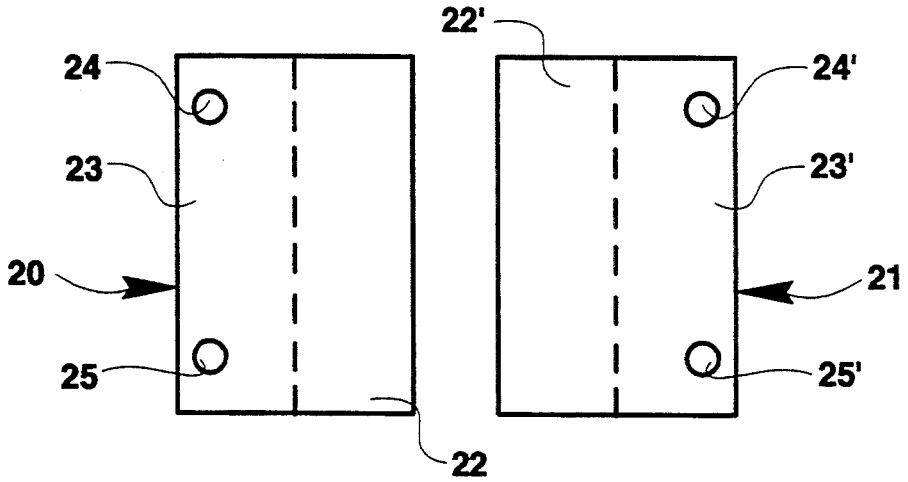
FIG. 2 illustrates an embodiment of the support means for use the dishwasher guard of FIG. 1.

FIG. 2 shows brackets 20 and 21 forming the support means for the dishwasher guard of the embodiment of FIG. 1. Each bracket has a fixing part 22, 22' for fixing on the dishwasher and a projecting part 23. On projecting parts 23, holes 24, 24' are provided for accommodating the bodies 11, 11' of the spring loaded locks 10, 10'. Holes 25, 25' are for receiving inserts 9 and 9', respectively. The brackets are fixed to the lateral walls of the dishwasher (or dishwasher door) using a strong adhesive. Other alternative are to use screws or rivets.

In another embodiment of the invention, the inserts are replaced with a rod fixed along the side 8 or 8' and projecting from both sides of the door. The ends of the rod are capped after insertion in the holes 25, 25'.

Figure 3:
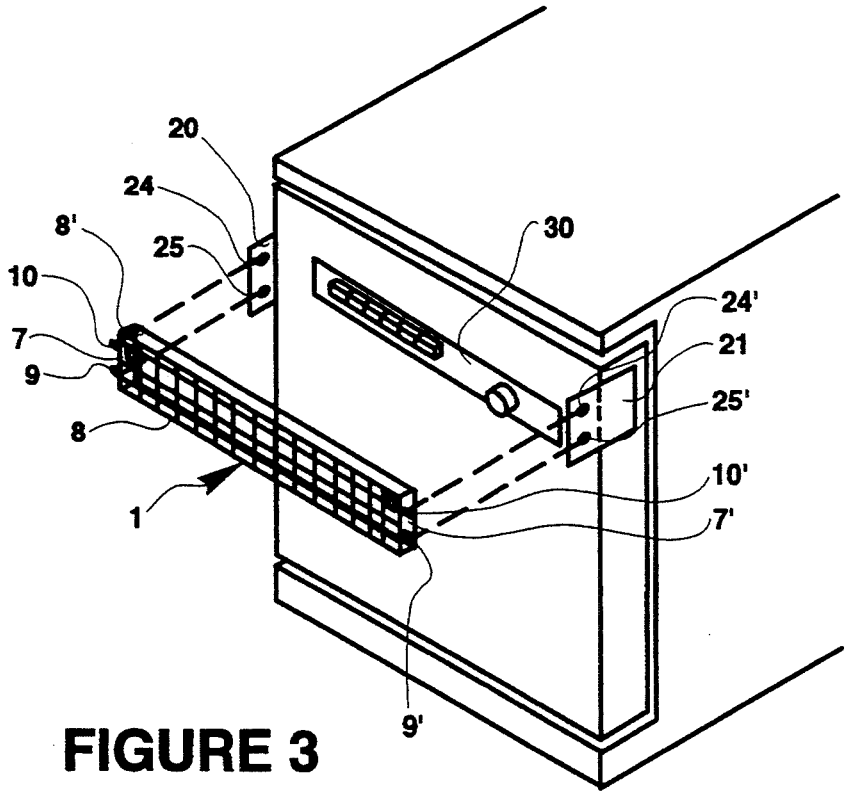
FIG. 3 is an exploded perspective view of a the dishwasher guard of FIGS. 1 and 2, in combination with a dishwasher.

As shown in FIG. 3, the door 1 is hinged on support brackets 20 and 21 by placing the inserts 9 and 9' in the holes 25, 25'. The right bracket 21 is fixed on the right wall of the dishwasher (or dishwasher door) at the height of the control panel 30. Similarly, the left bracket 20 is fixed on the left wall of the dishwasher (or dishwasher door). The door 1 pivots around inserts 9, 9'. The spring loaded locks 10 and 10' secure the door over the control panel. To this end, the bodies 11, 11' (see FIG. 1) are inserted in holes 24, 24' of the respective bracket 20 or 21. When bodies 11, 11' have entered in the respective holes, the door is closed and locked. The door may be unlocked and opened by pulling the heads 12, 12' to release the bodies 11, 11' from holes 24, 24'.

Figure 4:
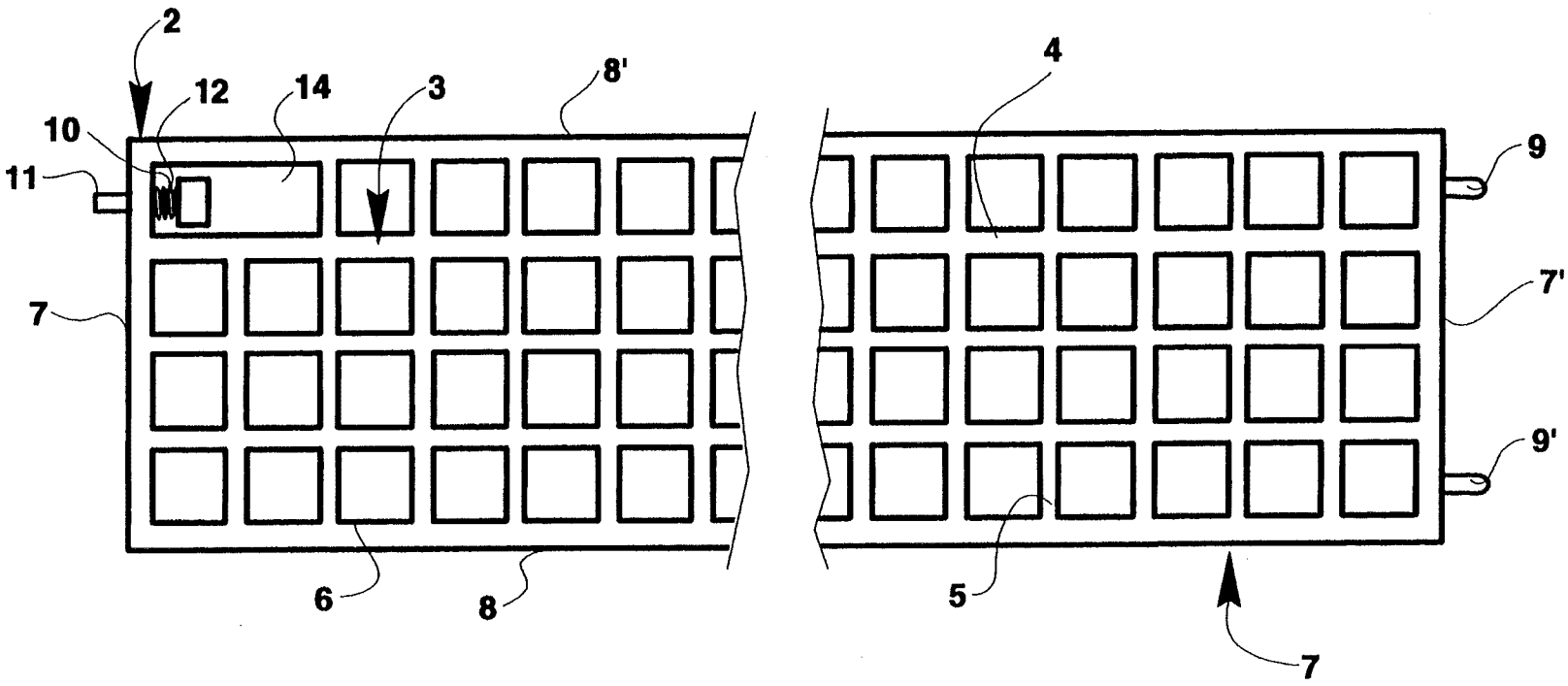
FIG. 4 illustrates the door of a dishwasher guard of another embodiment of the present invention.

In the embodiment of the door illustrated in FIG. 4, inserts 9 and 9' are provided on the right lateral margin of frame 2. The inserts are received in holes 24' and 25' of the right bracket 21. One latch 12 is arranged on the left side of the frame, for locking the door when inserted in hole 24 of left bracket 20. The location of latch 12 on left side of frame 2 is not restricted to that represented in FIG. 4. As well, two latches may be used for better securing the door.

Figure 5:
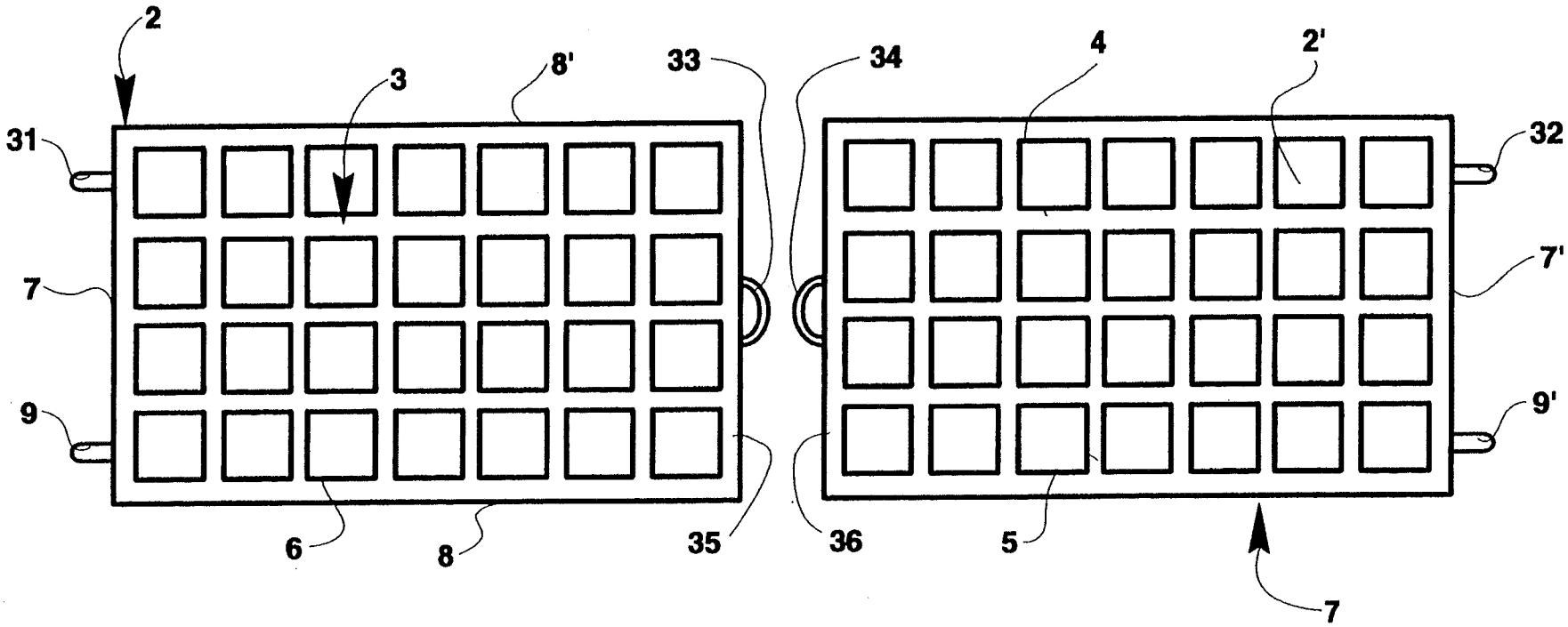
FIG. 5 illustrates still another embodiment of the door.

Another variant of the guard is represented in FIG. 5. The door is made of two sections, each having a respective frame 2, 2'. The door sections are hinged to a respective lateral bracket by use of inserts 9, 31 and 9', 32. Two catches are provided on the sides 35 and 36 of each frame, for locking the two sections to each other.

Various modifications of the disclosed embodiments will be evident to those skilled in the art and the scope of this invention is defined by the appended claims.

I claim:

1. A dishwasher guard for protecting a dishwasher control panel against accidental operation comprising:

support means including first and second bracket means each adapted to be fixed on a respective lateral side of the dishwasher at the level of the control panel thereof, each bracket being provided with means defining a hinge hole and a latch hole, door means comprising a substantially rectangular frame having a webbed facade fixed thereto and adapted to assume a closed position, when said control panel is protected and an open position, when said control panel is accessible, said door means being hingedly connected to said support means and wherein said latch means is operable to lock said door means in said closed position.

2. A dishwasher guard as claimed in claim 1, wherein said hinge means comprises a pair of inserts each arranged on a lateral side of said frame, each insert being adapted for insertion in the respective hinge hole of said brackets.

3. A dishwasher guard as claimed in claim 1, wherein said latch means comprises a pair of spring-loaded locks each arranged on a lateral side of said frame, each lock being adapted for insertion in the respective latching hole of said brackets, and said facade has two access openings for operating said spring-loaded locks.

4. A dishwasher guard as claimed in claim 1, wherein said support means comprises a first and a second bracket each adapted to be fixed on a lateral side of the dishwasher, said first bracket being provided with a pair of hinge holes and said second bracket being provided with a latch hole.

5. A dishwasher guard as claimed in claim 4, wherein said hinge means comprises a pair of inserts arranged on a lateral side of said frame, adapted for insertion in said pair of hinge holes of said first bracket.

6. A dishwasher guard as claimed in claim 1, wherein said latch means comprises a spring-loaded lock arranged on an lateral side of said frame, said lock being adapted for insertion in said latch hole of said second bracket, and said facade has an access openings for operating said spring-loaded lock.

7. A dishwasher guard as claimed in claim 1, wherein said door means comprises a first and a second door sections, each having a substantially rectangular frame with a webbed facade fixed thereto.

8. A dishwasher guard as claimed in claim 7, wherein said support means comprises a first and a second bracket adapted to be fixed on a lateral side of the dishwasher, each said bracket being provided with a pair of hinge holes.

9. A dishwasher guard as claimed in claim 8, wherein said hinge means comprises a pair of inserts arranged on a lateral side of each of said first and second frame, adapted for insertion in said pair of hinge holes of said first and second brackets, respectively.

10. A dishwasher guard as claimed in claim 7, wherein said latch means are arranged on an lateral side of said first and second frame, for locking said first door section to said second door section.

11. A dishwasher guard as claimed in claim 1, wherein said webbed facade has a mesh of less than $\frac{1}{4}$ inch in size.

12. A dishwasher guard as claimed in claim 1, wherein said guard is manufactured of a heat resistant material.

13. A dishwasher guard as claimed in claim 1, wherein said guard is manufactured of a heat resistant material.

* * * * *